US005840452A

United States Patent [19]

Kitagawa

[11] Patent Number: 5,840,452

[45] Date of Patent: Nov. 24, 1998

[54] PROCESS AND APPARATUS FOR ELECTROPHOTOGRAPHIC STATIC ELIMINATION

[75] Inventor: Seizo Kitagawa, Kawasaki, Japan

[73] Assignee: Fuji Electric Company, Ltd., Kanagawa, Japan

[21] Appl. No.: 758,444

[22] Filed: Nov. 29, 1996

[30] Foreign Application Priority Data

Dec. 5, 1995 [JP] Japan ..... 7-316205

[51] Int. Cl.[6] ..... G03G 21/08

[52] U.S. Cl. ..... 430/31; 430/34; 399/43

[58] Field of Search ..... 430/31, 34; 399/43

[56] References Cited

U.S. PATENT DOCUMENTS

| | | | |
|---|---|---|---|
| 4,288,514 | 9/1981 | Kutsuwada et al. | 430/5 Y |
| 4,827,306 | 5/1989 | Tsujimoto et al. | 355/3 GH |
| 5,164,771 | 11/1992 | Suzuki et al. | 355/208 |
| 5,272,504 | 12/1993 | Omura et al. | 355/218 |
| 5,481,337 | 1/1996 | Tsuchiya et al. | 355/208 |
| 5,510,880 | 4/1996 | Song | 355/228 |

FOREIGN PATENT DOCUMENTS

| | | |
|---|---|---|
| 358157 | 12/1992 | Japan . |
| 6318023 | 11/1994 | Japan . |

OTHER PUBLICATIONS

Nakamura, Yoichi, JP 04/358,157A, Nov. 12, 1992, *Patent Abstracts of Japan,* vol. 017, No. 228, (P–1531), May 11, 1993.

*Primary Examiner*—John Goodrow
*Attorney, Agent, or Firm*—Spencer & Frank

[57] ABSTRACT

An electrophotographic process includes providing an organic photoconductor comprised of a charge generation layer and a charge transport layer containing a poly (alkanedioic acid 2,6-dimethoxyanthracene-9,10-diol ester) resin formed on a conductive substrate, and having a half decay exposure; and eliminating static from the organic photoconductor by illuminating the organic photoconductor with a static elimination light having a wavelength ranging from 520 to 680 nm and with a dose of the static elimination light which ranges from 3 to 10 times the half decay exposure of the organic photoconductor. Preferably, the wavelength of the static elimination light ranges from 550 to 650 nm. An electrophotographic apparatus includes an organic photoconductor comprising a charge generation layer and a charge transport layer containing a poly (alkanedioic acid 2,6-dimethoxyanthracene-9,10-diol ester) resin formed on a conductive substrate, and having a half decay exposure; a static elimination light source providing light having a peak wavelength ranging from 520 to 680 nm, and providing an irradiation dose of the light ranging from 3 to 10 times the half decay exposure of the organic photoconductor; and a controller for correctively controlling developing bias in response to one of (a) temperature and relative humidity in the surroundings of the organic photoconductor or (b) accumulated number of repeated uses of the organic photoconductor; and a sensor for sensing temperature and relative humidity.

8 Claims, 3 Drawing Sheets

PROCESS AND APPARATUS FOR ELECTROPHOTOGRAPHIC STATIC ELIMINATION

BACKGROUND OF THE INVENTION

1. Field of the Invention

This invention relates to an electrophotographic process and an electrophotographic apparatus for wet development which employ an organic photoconductor, and which find use in a printer, a plotter and a facsimile.

2. Description of the Prior Art

The development process included in the electrophotographic process is divided into two types, wet development and dry development. Wet development can employ a fine toner as compared with dry development, and thus obtain a high resolution, high grade image. This is behind extensive development efforts made in recent years on this type of process. FIG. 1 is a schematic sectional view of the essential part of a conventional electrophotographic apparatus for wet development. A photoconductor 1 rotates clockwise at a constant speed, and the electrophotographic process is performed in the following order on the surface of a photosensitive layer 1*b* of the photoconductor 1: charging by a charger 2; exposure to a printing pattern by an exposure light source 3; development, formation of a toner image of the printing pattern, by a wet developing device 4; transfer of the toner image onto a transfer paper 6 by a transfer electrode 5; scrape of toner with a blade 7; and elimination of static electricity by a static elimination light source 8. A developing solution 4*a* containing a toner is carried by a developing roller 4*b*. The toner is attracted onto the photosensitive layer 1*b* by a developing bias which is applied between a photoconductor substrate 1*a* and the developing roller 4*b* by a developing bias power source 4*c*. Thus, a visible image is developed.

Generally, an organic photoconductor is apt to absorb a petroleum solvent, such as isopar, used in a developing solution. As a result, its characteristics may decline, or its photosensitive layer may soften, resulting in the failure to maintain image quality. Thus, the electrophotographic process involving wet development has hitherto used inorganic photoconductors comprising substances such as selenium, but because of their prices and difficulty with their disposal, organic photoconductors have attracted wider attention.

Of organic photoconductors with improved solvent resistance, a separated-function organic photoconductor having a charge generation layer as an inner layer and a charge transport layer containing a poly(alkanedioic acid 2,6-dimethoxyanthracene-9,10-diol ester) resin as an outermost layer (Japanese Patent Application Laid-Open No. 358157/1992) has relatively high solvent resistance, and has come into practical use.

However, this organic photoconductor is slightly inferior to conventional organic photoconductors for dry development in terms of the stability to temperature and humidity (environmental stability) and the stability of characteristics during repeated use (repetition stability). Thus, this organic photoconductor has posed the problem of lowering the reproducibility of print under changing environment or during repeated use when the conventional electrophotographic process is employed.

SUMMARY OF THE INVENTION

The object of the present invention is to provide an electrophotographic process capable of always obtaining a high image quality under changing environment and during repeated use even when using the aforementioned separated-function organic photoconductor.

In the first aspect of the present invention, there is provided an electrophotographic process using an organic photoconductor having a charge generation layer and a charge transport layer formed on a conductive substrate, wherein the wavelength of static elimination light used in the static elimination step is 520 to 680 nm, and the dose of the static elimination light is 3 to 10 times its half decay exposure.

Here, the charge transport layer may contain a poly (alkanedioic acid 2,6-dimethoxyanthracene-9,10-diol ester) resin.

The wavelength of the static elimination light may be 550 to 650 nm.

In the second aspefct of the present invention, there is provided an electrophotographic process using an organic photoconductor having a charge generation layer and a charge transport layer formed on a conductive substrate, wherein the wavelength of static elimination light used in the static elimination step is 520 to 680 nm, the dose of the static elimination light is 3 to 10 times its half decay exposure, and the developing bias is correctively controlled in response to the temperature and relative humidity in the surroundings of the photoconductor.

Here, the charge transport layer may contain a poly (alkanedioic acid 2,6-dimethoxyanthracene-9,10-diol ester) resin.

The wavelength of the static elimination light may be 550 to 650 nm.

In the third aspect of the present invention, there is provided an electrophotographic process using an organic photoconductor having a charge generation layer and a charge transport layer formed on a conductive substrate, wherein the wavelength of static elimination light used in the static elimination step is 520 to 680 nm, the dose of the static elimination light is 3 to 10 times its half decay exposure, and the developing bias is correctively controlled in response to the accumulated number of repeated uses.

Here, the charge transport layer may contain a poly (alkanedioic acid 2,6-dimethoxyanthracene-9,10-diol ester) resin.

The wavelength of the static elimination light may be 550 to 650 nm.

In the fourth aspect of the present invention, there is provided an electrophotographic apparatus including an organic photoconductor and a static elimination light source, the organic photoconductor having a charge generation layer and a charge transport layer formed on a conductive substrate, wherein light from the static elimination light source has a peak wavelength of 520 to 680 nm, and the irradiation dose of the light is 3 to 10 times its half decay exposure.

Here, the charge transport layer may contain a poly (alkanedioic acid 2,6-dimethoxyanthracene-9,10-diol ester) resin.

In the fifth aspect of the present invention, there is provided an electrophotographic apparatus including an organic photoconductor and a static elimination light source, the organic photoconductor having a charge generation layer and a charge transport layer formed on a conductive substrate, wherein the electrophotographic apparatus further includes a controller and a temperature/humidity sensor, light from the static elimination light source has a peak wavelength of 520 to 680 nm, and the irradiation dose of the light is 3 to 10 times its half decay exposure.

Here, the charge transport layer may contain a poly (alkanedioic acid 2,6-dimethoxyanthracene-9,10-diol ester) resin.

In the sixth aspect of the present invention, there is provided an electrophotographic apparatus including an organic photoconductor and a static elimination light source, the organic photoconductor having a charge generation layer and a charge transport layer formed on a conductive substrate, wherein the electrophotographic apparatus further includes a controller and a counter, light from the static elimination light source has a peak wavelength of 520 to 680 nm, and the irradiation dose of the light is 3 to 10 times its half decay exposure.

Here, the charge transport layer may contain a poly (alkanedioic acid 2,6-dimethoxyanthracene-9,10-diol ester) resin.

The above and other objects, effects, features and advantages of the present invention will become more apparent from the following description of the embodiments thereof taken in conjunction with the accompanying drawings.

DETAILED DESCRIPTION OF PREFERRED EMBODIMENTS

Figure 1:
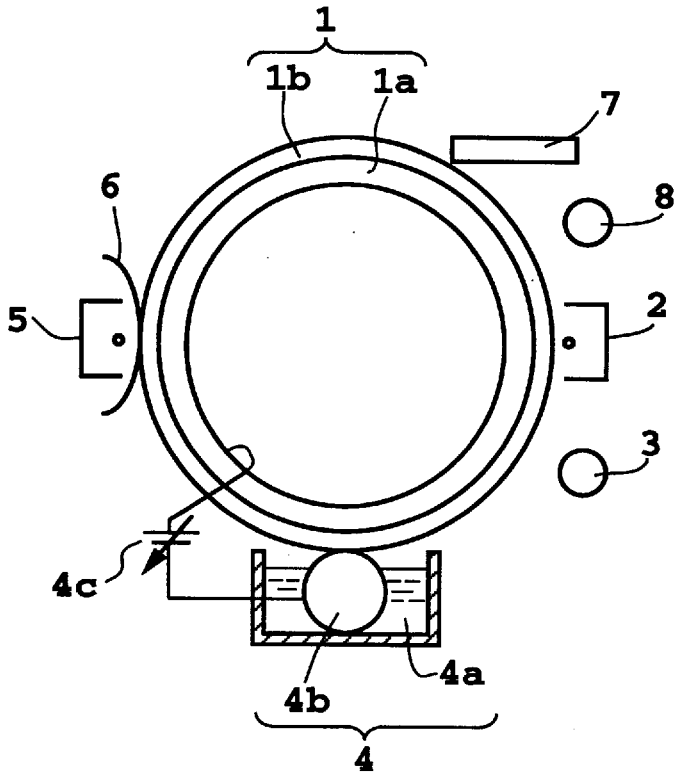
FIG.1 (PRIOR ART)
FIG. 1 is a schematic sectional view of the essential part of a conventional electrophotographic apparatus.

On the surface of a cylindrical aluminum substrate 80 mm in diameter and 360 mm in length, there were formed a 0.5 μm thick undercoat layer of a polyamide resin, and a 0.5 μm thick charge generation layer containing metal-free phthalocyanine. A coating solution comprising 20 parts by weight of poly(dodecanedioic acid 2,6-dimethoxyanthracene-9,10-diol ester) resin with an average degree of polymerization of 200, and 280 parts by weight of tetrachloroethylene was coated onto the charge generation layer, followed by drying, to form a charge transport layer 20 μm thick. An organic photoconductor was thus produced. In this embodiment, the resin containing dodecanedioic acid was used, but the resin containing an alkanedioic acid having 9 to 15 carbon atoms, ranging from nonanedioic acid to pentadecanedioic acid, instead of dodecanedioic acid, may be used.

The so prepared organic photoconductor was mounted on an electrophotographic apparatus for wet development, including a laser at 780 nm as an exposure light source. The peak wavelength of light from a static elimination light source was set at 500, 550, 600, 650 and 700 nm, and the irradiation dose at each wavelength was changed to 2, 3, 5, 10 and 15 times the half decay exposure ($E_{1/2}$) of the light. Under these conditions, memory phenomenon and image fog were examined. The memory phenomenon is the phenomenon that a previously printed pattern such as a letter appears in a subsequently printed image. The image fog is a gray appearance in an unprinted blank part of paper caused by toner deposition.

Table 1 shows the memory phenomenon and the image fog versus the peak wavelength and irradiation dose of light from the static elimination light source. The circle ○ shows that neither the memory phenomenon nor the image fog occurred. The triangle Δ indicates that the memory phenomenon or the image fog was slightly noted.

TABLE 1

| Peak wavelength | Image | Static elimination light irradiation dose ($E_{1/2} \times N$) N (times) | | | | |
|---|---|---|---|---|---|---|
| (nm) | quality | 2 | 3 | 5 | 10 | 15 |
| 500 | Memory phenomenon | Δ | Δ | Δ | Δ | ○ |
| | Image fog | ○ | ○ | ○ | ○ | Δ |
| 550 | Memory phenomenon | Δ | ○ | ○ | ○ | ○ |
| | Image fog | ○ | ○ | ○ | ○ | Δ |
| 600 | Memory phenomenon | Δ | ○ | ○ | ○ | ○ |
| | Image fog | ○ | ○ | ○ | ○ | Δ |
| 650 | Memory phenomenon | Δ | ○ | ○ | ○ | ○ |
| | Image fog | ○ | ○ | ○ | ○ | Δ |
| 700 | Memory phenomenon | Δ | ○ | ○ | ○ | ○ |
| | Image fog | ○ | Δ | Δ | Δ | Δ |

Table 1 shows that when light having a peak wavelength of 550 to 650 nm from the static elimination light source was projected at a dose of 3 to 10 times the half decay exposure, neither the memory phenomenon nor the image fog occurred, obtaining a satisfactory image quality. That is, the lower limit of the peak wavelength of appropriate static elimination light was 520 nm, nearly intermediate between 500 nm and 550 nm, while its upper limit was 680 nm, nearly intermediate between 650 nm and 700 nm.

Figure 2:
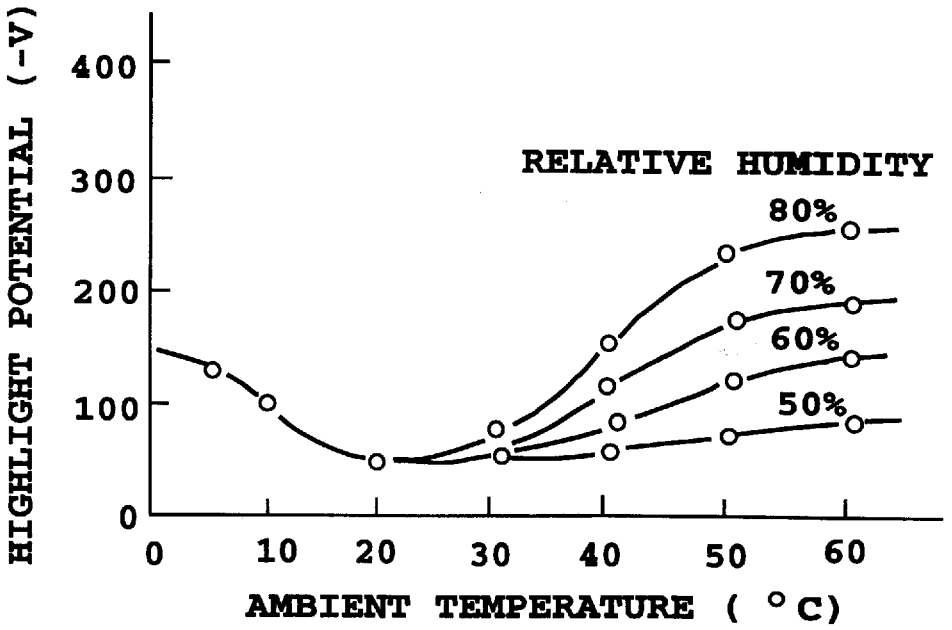
FIG. 2 is a graph showing a profile of the highlight potential dependent on the temperature and humidity in the surroundings of a photoconductor.

Next, the environment of the electrophotographic apparatus was changed. That is, the temperature and relative humidity in the surroundings of the photoconductor inside the electrophotographic apparatus were changed within the ranges of from 5° to 45° C. and from 50 to 80%, respectively. Under these conditions, the environment dependence of the highlight potential was examined, with the peak wavelength of static elimination light being set at 600 nm, and its irradiation dose at 5 times the half decay exposure. FIG. 2 depicts the dependence of the highlight potential on the temperature and humidity in the surroundings of the photoconductor. From this graph, the highlight potential was found to increase as the relative humidity increased in a high temperature zone of 30° C. and above.

Figure 3:
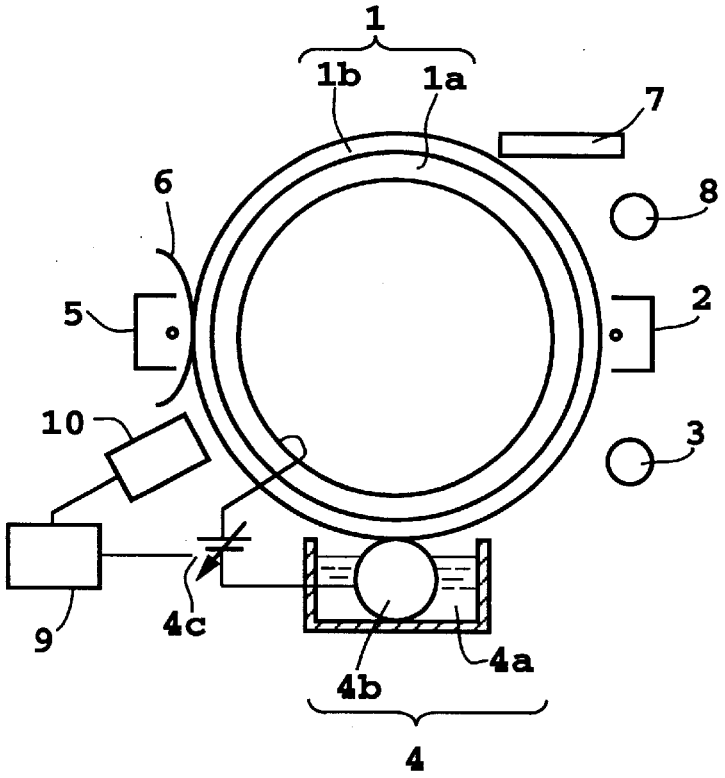
FIG. 3 is a schematic sectional view of the essential part of an electrophotographic apparatus according to the present invention.

Based on the data of this graph, the electrophotographic process of the aforementioned electrophotographic apparatus was improved so that the developing bias could be increased by the increment of the highlight potential in response to changes in the environment surrounding the photoconductor. An image obtained by this improved electrophotographic process was examined for the printing density and resolution. FIG. 3 is a schematic sectional view of the essential part of an electrophotographic apparatus the present invention has been applied to. Most of the structure of this electrophotographic apparatus is the same as the structure of the conventional electrophotographic apparatus shown in FIG. 1. Thus, only the part related to correction of the developing bias is described herein. A temperature/humidity sensor 10 and a controller 9 were provided in addition to the structure of the conventional electrophotographic apparatus. The controller 9 has already stored data for correction of the highlight potential responsive to temperature and humidity (FIG. 2), and a computing equation for the relationship between the input voltage and the bias voltage of the developing bias power source 4*c*. Output voltage from the temperature/humidity sensor 10 in response to input voltage is entered as input voltage into the developing bias power source 4*c*. The developing bias power source 4*c* produces a corrected value of the developing bias voltage corresponding to the input voltage received.

As a control, an image obtained by an unimproved electrophotographic apparatus was also examined for the printing density and resolution. Table 2 gives the evaluations of the printing density and resolution under varying environment.

TABLE 2

| | Image quality | Temperature (°C.)/humidity (%) 5/30 | 20/50 | 35/70 | 45/70 |
|---|---|---|---|---|---|
| This invention | Printing density | ○ | ○ | ○ | ○ |
| | Resolution | ○ | ○ | ○ | ○ |
| Control | Printing density | Δ | ○ | Δ | Δ |
| | Resolution | ○ | ○ | Δ | Δ |

Table 2 shows that with the conventional electrophotographic process, the printing density and the resolution both deteriorated at the low and high temperatures, while according to the improved electrophotographic process of the present invention, the printing density and the resolution were both satisfactory without depending on the environment. These results demonstrate the effectiveness of the above-described measures against temperature and humidity.

Figure 4:
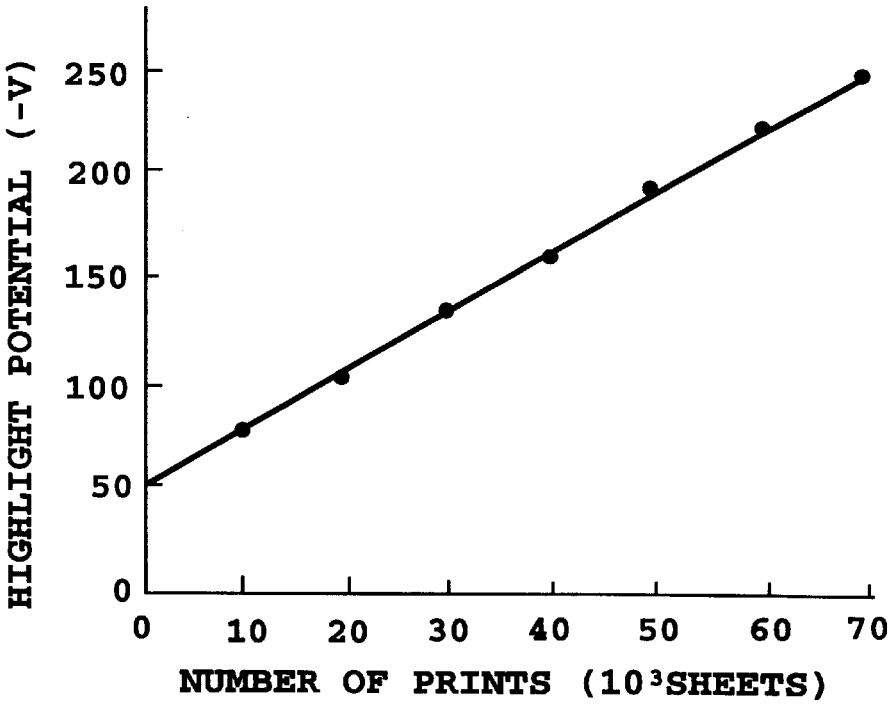
FIG. 4 is a graph showing the relationship between the number of JIS A4 size papers printed and the highlight potential of the photoconductor.

Furthermore, the photoconductor of the above-mentioned electrophotographic apparatus was examined for changes in the highlight potential after continuous, repeated use. The temperature and humidity during the use were set at 20° C. and 40%, respectively. The static elimination conditions were such that the peak wavelength of light from the static elimination light source was 600 nm, and the irradiation dose of the light was 5 times the half decay exposure. The frequency of continuous, repeated use was expressed as the number of printed JIS A4 sheets from the practical point of view. FIG. 4 illustrates changes in the highlight potential of the photoconductor according to the number of printed JIS A4 sheets. After 70,000 A4 sheets were printed, the highlight potential rose to about 250 V. The increased highlight potential lowered to several tens of volts after the photoconductor was allowed to stand for about 1 day. However, printing of about 10 sheets resulted in a value corresponding to the value obtained with the accumulated number of prints.

Figure 5:
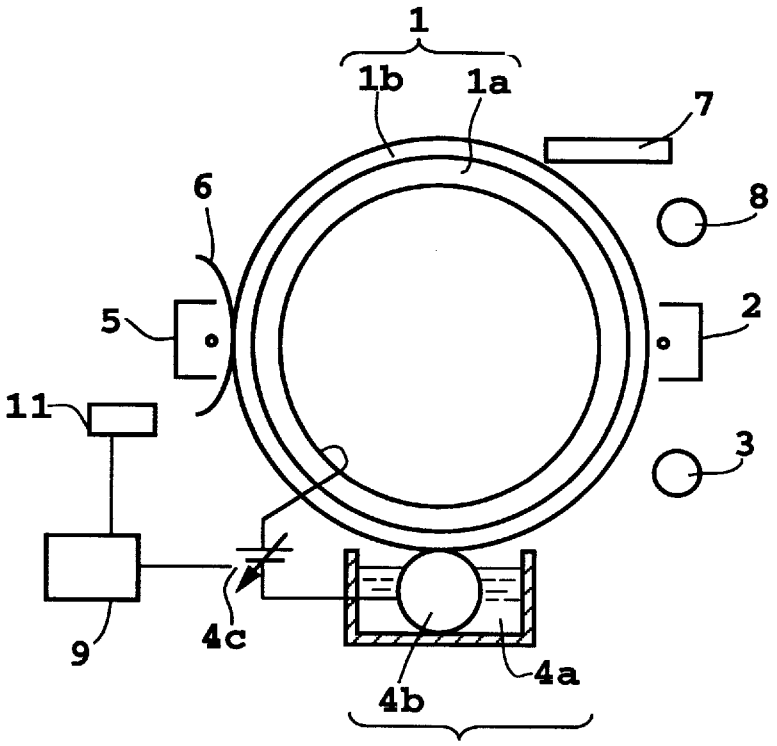
FIG. 5 is a schematic sectional view of the essential part of an electrophotographic apparatus according to another embodiment of the present invention.

Based on the above data, the electrophotographic process of the aforementioned electrophotographic apparatus was improved such that the developing bias could be increased by the increment of the highlight potential in response to the accumulated number of printed sheets. An image obtained by this improved process was examined for the printing density and resolution. FIG. 5 is a schematic sectional view of the essential part of an electrophotographic apparatus concerned with another embodiment of the present invention.

A counter 11 displaying an electric output on the accumulated number of printed sheets, and a controller 9 were provided in addition to the structure of the electrophotographic apparatus of FIG. 1. As with the aforesaid correction responsive to temperature and humidity, the relationship between the output of the counter 11 and the output of the controller 9 was established.

As a control, an image obtained by an unimproved electrophotographic apparatus was also examined for the printing density and resolution. Table 3 gives the evaluations of the printing density and resolution after repeated use expressed as the number of printed sheets.

TABLE 3

| | Image quality | Number of prints as repeated use parameter Initial | 10,000 | 20,000 | 50,000 |
|---|---|---|---|---|---|
| This invention | Printing density | ○ | ○ | ○ | ○ |
| | Resolution | ○ | ○ | ○ | ○ |
| Control | Printing density | ○ | ○ | Δ | Δ |
| | Resolution | ○ | ○ | ○ | ○ |

Table 3 shows that with the conventional electrophotographic process, the printing density of the image deteriorated after printing of 20,000 sheets as repeated use parameter, while the image obtained by the improved electrophotographic process of the present invention was satisfactory in both of the printing density and the resolution without depending on the number of prints as repeated use parameter. These results demonstrate the effectiveness of the above-described measures against repeated use.

According to the present invention, which concerns an electrophotographic process for wet development using an organic photoconductor having a charge transport layer containing a highly solvent-resistant poly(alkanedioic acid 2,6-dimethoxyanthracene-9,10-diol ester) resin, a satisfactory image quality with minimal memory and minimal fog can be obtained by projecting light, having a peak wavelength at 520 to 680 nm, from a static elimination light source at an irradiation dose of 3 to 10 times its half decay exposure.

Moreover, an image with stable printing density and resolution can be obtained without depending on the environment by monitoring ambient temperature and humidity, and correctively controlling the developing bias in response to the results of monitoring.

Furthermore, an image with stable printing density and resolution can be obtained without depending on the number of prints as a repeated use parameter, by correctively controlling the developing bias in response to an increase in the highlight potential according to an increase in the number of prints.

The present invention has been described in detail with respect to various embodiments, and it will now be apparent from the foregoing to those skilled in the art that changes and modifications may be made without departing from the invention in its broader aspects, and it is our intention, therefore, in the appended claims to cover all such changes and modifications as fall within the true spirit of the invention.

What is claimed is:

1. An electrophotographic process, comprising:

a. providing an organic photoconductor comprised of a charge generation layer and a charge transport layer containing a poly(alkanedioic acid 2,6-dimethoxyanthracene-9,10-diol ester) resin formed on a conductive substrate, and having a half decay exposure; and b. eliminating static from the organic photoconductor by illuminating the organic photoconductor with a static elimination light having a wavelength ranging from 520 to 680 nm and with a dose of the static elimination light which ranges from 3 to 10 times the half decay exposure of the organic photoconductor.

2. The electrophotographic process as claimed in claim 1, wherein the wavelength of the static elimination light ranges from 550 to 650 nm.

3. An electrophotographic process, comprising:

a. providing an organic photoconductor comprised of a charge generation layer and a charge transport layer containing a poly(alkanedioic acid 2,6-dimethoxyanthracene-9,10-diol ester) resin formed on a conductive substrate, and having a half decay exposure; and b. eliminating static from the organic photoconductor by illuminating the organic photoconductor with a static elimination light having a wavelength ranging from 520 to 680 nm and with a dose of the static elimination light which ranges from 3 to 10 times the half decay exposure of the organic photoconductor; and c. correctively controlling developing bias in response to temperature and relative humidity in the surroundings of the organic photoconductor.

4. The electrophotographic process as claimed in claim 3, wherein the wavelength of the static elimination light ranges from 550 to 650 nm.

5. An electrophotographic process, comprising:

a. providing an organic photoconductor comprised of a charge generation layer and a charge transport layer containing a poly(alkanedioic acid 2,6-dimethoxyanthracene-9,10-diol ester) resin formed on a conductive substrate, and having a half decay exposure; and b. eliminating static from the organic photoconductor by illuminating the organic photoconductor with a static elimination light having a wavelength ranging from 520 to 680 nm and with a dose of the static elimination light which ranges from 3 to 10 times the half decay exposure og the organic photoconductor; and c. correctively controlling developing bias in response to accumulated number of repeated uses of the organic photoconductor.

6. The electrophotographic process as claimed in claim 5, wherein the wavelength of the static elimination light ranges from 550 to 650 nm.

7. An electrophotographic apparatus, comprising:

an organic photoconductor comprising a charge generation layer and a charge transport layer containing a poly (alkanedioic acid 2,6-dimethoxyanthracene-9,10-diol ester) resin formed on a conductive substrate, and having a half decay exposure; and a static elimination light source providing light having a peak wavelength ranging from 520 to 680 nm, and providing an irradiation dose of the light ranging from 3 to 10 times the half decay exposure of the organic photoconductor.

8. An electrophotographic apparatus, comprising:

an organic photoconductor comprising a charge generation layer and a charge transport layer containing a poly (alkanedioic acid 2,6-dimethoxyanthracene-9,1-diol ester) resin formed on a conductive substrate, and having a half decay exposure;

a static elimination light source providing light having a peak wavelength ranging from 520 to 680 nm, and providing an irradiation dose of the light ranging from 3 to 10 times the half decay exposure of the organic photoconductor; and a controller for correctively controlling developing bias in response to one of (a) temperature and relative humidity in the surroundings of the organic photoconductor or (b) accumulated number of repeated uses of the organic photoconductor; and a sensor for sensing temperature and relative humidity.

* * * * *